US006045246A

United States Patent [19]

Goto

[11] Patent Number: 6,045,246

[45] Date of Patent: Apr. 4, 2000

[54] VEHICLE LAMP

[75] Inventor: Takayoshi Goto, Shizuoka, Japan

[73] Assignee: Koito Manufacturing Co., Ltd., Tokyo, Japan

[21] Appl. No.: 09/246,127

[22] Filed: Feb. 8, 1999

[30] Foreign Application Priority Data

Feb. 17, 1998 [JP] Japan ..... 10-034384

[51] Int. Cl.[7] ..... F21V 5/00

[52] U.S. Cl. ..... 362/521; 362/331

[58] Field of Search ..... 362/520, 521, 362/546, 549, 331

[56] References Cited

U.S. PATENT DOCUMENTS 4,972,302 11/1990 Masuyama et al. ..... 362/521
5,562,338 10/1996 Yamamoto ..... 362/61
5,658,072 8/1997 Natsume et al. ..... 362/521

*Primary Examiner*—Stephen Husar
*Attorney, Agent, or Firm*—Morgan, Lewis & Bockius LLP

[57] ABSTRACT

A vehicle lamp including: a lamp chamber accommodating a reflector for forwards reflecting light emitted from a light source, an inner lens and an outer lens disposed at a front opening of the reflector such that the two lenses are, by projection-and-pit lance engagement, secured to an elongating lens-engaging portion formed along the front opening of the reflector, wherein the inner lens and the outer lens are integrally secured to each other by projection-and-pit lance engagement, and either of the two lenses is secured to (an engagement hole) the elongating lens-engaging portion by the projection-and-pit lance engagement. The number of the visible projection-and-pit lance engagement holes provided for the lens engagement portion and of the reflector, respectively, and arranged to secure the lens can be reduced as compared with a conventional structure.

6 Claims, 6 Drawing Sheets

VEHICLE LAMP

BACKGROUND OF THE INVENTION

1. Field of the Invention

The present invention relates to a vehicle lamp having an inner lens and an outer lens provided for a front opening of a reflector in a lamp chamber, and more particularly to a vehicle lamp structured to secure the lenses by projection-and-pit lance engagement.

2. Related Art

FIGS. 8 and 9 are diagrams showing an example of the conventional lamp. The conventional lamp includes a lamp body 1 and a front cover 2 so that a lamp chamber is defined. A reflector 3 is secured by a predetermined securing means to the lamp body 1 and disposed within the lamp chamber. An inner lens 6 and an outer lens 7 are coupled to a front opening of the reflector. A bulb 4 is received in a bulb receiving opening 1a formed at the top end of the lamp body 1 and forwards projecting over a bulb insertion hole 3a of the reflector 3.

An elongating lens engagement portion 5 extending along the front opening of the reflector 3 is provided for the front opening of the reflector 3. A couple of holes 5*a* and 5*b* with which legs 6*a* and 7*a* of the lenses 6 and 7 are engageable are formed in the outer peripheral of the lens engagement portion 5 at the same intervals in the circumferential direction of the lens engagement portion 5. When the legs 6*a* and 7*a* of the lenses 6 and 7 are engaged to the openings 5*a* and 5*b* by projection-and-pit lance manner, the lenses 6 and 7 are secured to the reflector 3.

The conventional lamp structured as mentioned above, however, suffers from a problem in that the holes 5*a* and 5*b* provided for the lens engagement portion 5 are viewed through the front cover 2 as shadows as indicated with diagonal lines shown in FIG. 8. Thus, the external appearance (the quality of the shape) of the lamp deteriorates.

SUMMARY OF THE INVENTION

In view of the foregoing problem accompanying the conventional structure, an object of the present invention is to provide a vehicle lamp having an improved external appearance by reducing the number of projection-and-pit lance engagement holes provided for a reflector and structured to secure lenses.

The above and other objects can be achieved by a provision of a vehicle lamp which, according to the present invention, includes: a lamp chamber accommodating therein a reflector for reflecting forward light emitting from a light source, an inner lens and an outer lens disposed at a front opening of the reflector such that the two lenses are, by projection-and-pit lance engagement, secured to an elongating lens-engaging portion formed along the front opening of the reflector, wherein the inner lens and the outer lens are integrally secured to each other by the projection-and-pit lance engagement, and either of the two lenses is secured to the elongating lens-engaging portion by the projection-and-pit lance engagement.

Only either of the inner lens or the outer lens is directly secured to the reflector by the projection-and-pit lance engagement. That is, the number of the projection-and-pit lance engagement holes provided for the elongating lens-engaging portion of the reflector and structured to secure the lenses is smaller than that of the conventional structure.

In a vehicle lamp according to another aspect of the present invention, an inclined surface for introducing external light into a projection-and-pit lance engagement portion formed between the lenses is provided for at least a position of the elongating lens-engaging portion of the reflector which corresponds to the projection-and-pit lance engagement portion formed between said lenses.

The projection-and-pit lance engagement portion formed between the lenses is somewhat dark as compared with other regions (regions in each of which the projection-and-pit lance engagement portion between the lenses is not formed). Light reflected by the inclined surface provided for the elongating lens-engaging portion of the reflector is introduced into the projection-and-pit lance engagement portion formed between the lenses. Thus, the difference in the contrast between the projection-and-pit lance engagement portion formed between the lenses and the other regions (regions in each of which the projection-and-pit lance engagement portion between the lenses is not formed) through the outer lens can be reduced. Thus, the projection-and-pit lance engagement portion between the lenses can be made to be inconspicuous.

According to still another aspect of the invention, the inclined surface provided for the elongating lens-engaging portion is subjected to a reflecting process.

Light reflected by the inclined reflecting surface provided for the elongating lens-engaging portion of the reflector is efficiently introduced into the projection-and-pit lance engagement portion formed between the lenses. Thus, the difference in the contrast between the projection-and-pit lance engagement portion formed between the lenses and the other regions (regions in each of which the projection-and-pit lance engagement portion between the lenses is not formed) through the outer lens can be reduced. Thus, the projection-and-pit lance engagement portion between the lenses can furthermore be made to be inconspicuous.

Further, in a still another aspect of the invention, the elongating lens-engaging portion of the reflector has a groove for accommodating the projection-and-pit lance engagement portion formed between the lenses, and the inclined surface is formed in a bottom portion of the groove.

The groove for accommodating the projection-and-pit lance engagement portion formed between the lenses positions the lenses with respect to the reflector.

Furthermore, in the vehicle lamp of the present invention, the projection-and-pit lance engagement portion formed between the lens and the reflector is composed of a hook-shape leg rearwards extending over the outer periphery of the inner lens and a leg engaging hole provided for the elongating lens-engaging portion of the reflector, the projection-and-pit lance engagement portion formed between the two lenses is composed of a projection formed over the outer periphery of the inner lens and a projecting engagement hole formed in the leg extending rearwards over the outer periphery of the outer lens.

The projection-and-pit lance engagement hole (the leg engaging hole) to which the leg of the inner lens is engaged and provided for the reflector is covered with the outer lens which covers the inner lens so as to be inconspicuous.

In the vehicle lamp of the present invention, moreover, a plurality of the reflectors are provided in the lamp chamber, and each of the reflectors is provided with an inner lens colored in a function color and a clear outer lens structured to cover the inner lens and having diffusing steps.

The clear outer lens having the diffusing steps causes the function colors of the inner lenses to be colors as if the colors are filtered by a white filter. Therefore, an integrated state is realized in the overall inner portion of the lamp chamber.

DESCRIPTION OF THE PREFERRED EMBODIMENTS

An embodiment of the present invention will now be described with reference to accompanying drawings.

Figure 1:
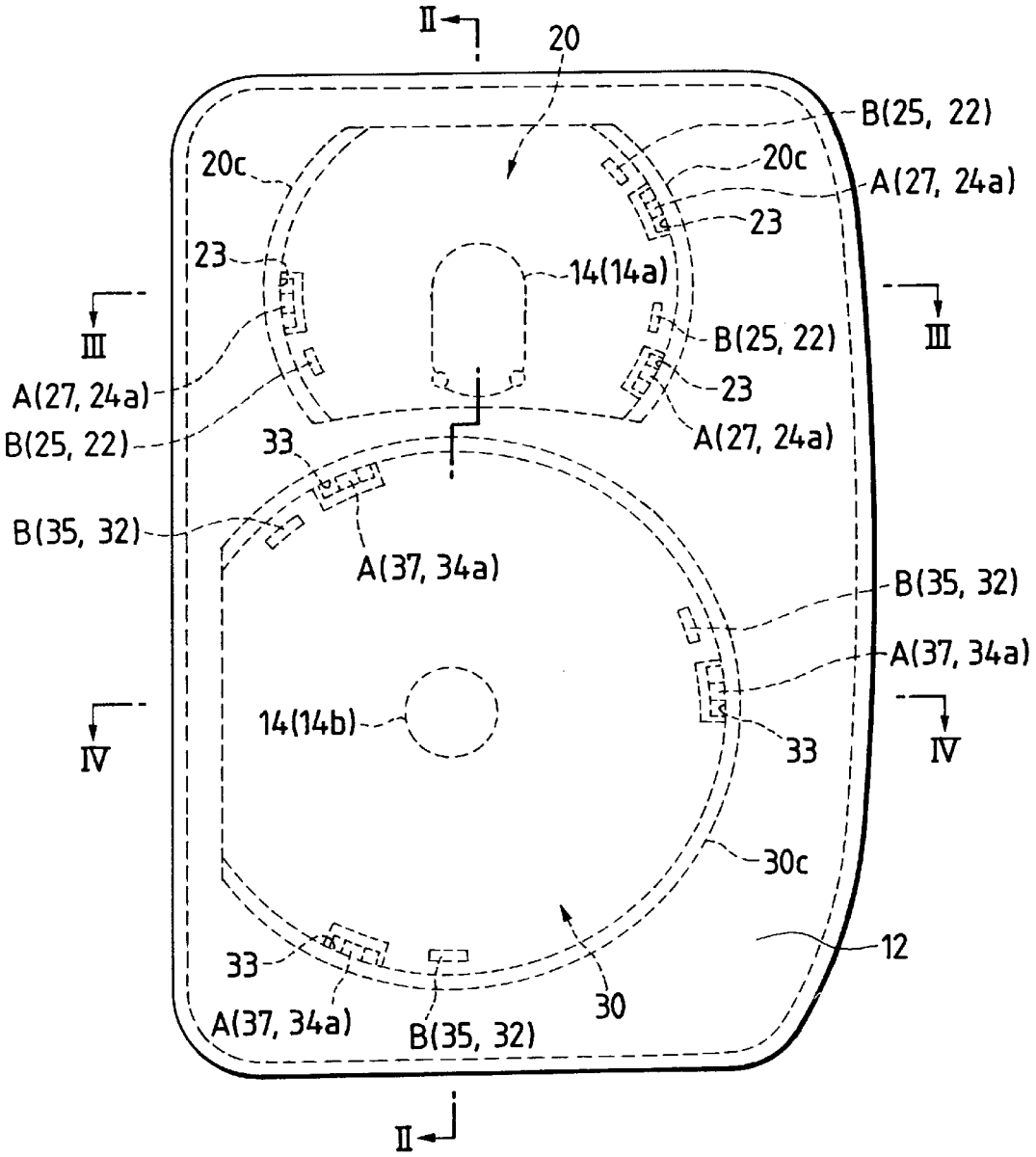
FIG. 1 is a front view showing a rear combination vehicle lamp according to an embodiment of the present invention.
Figure 2:
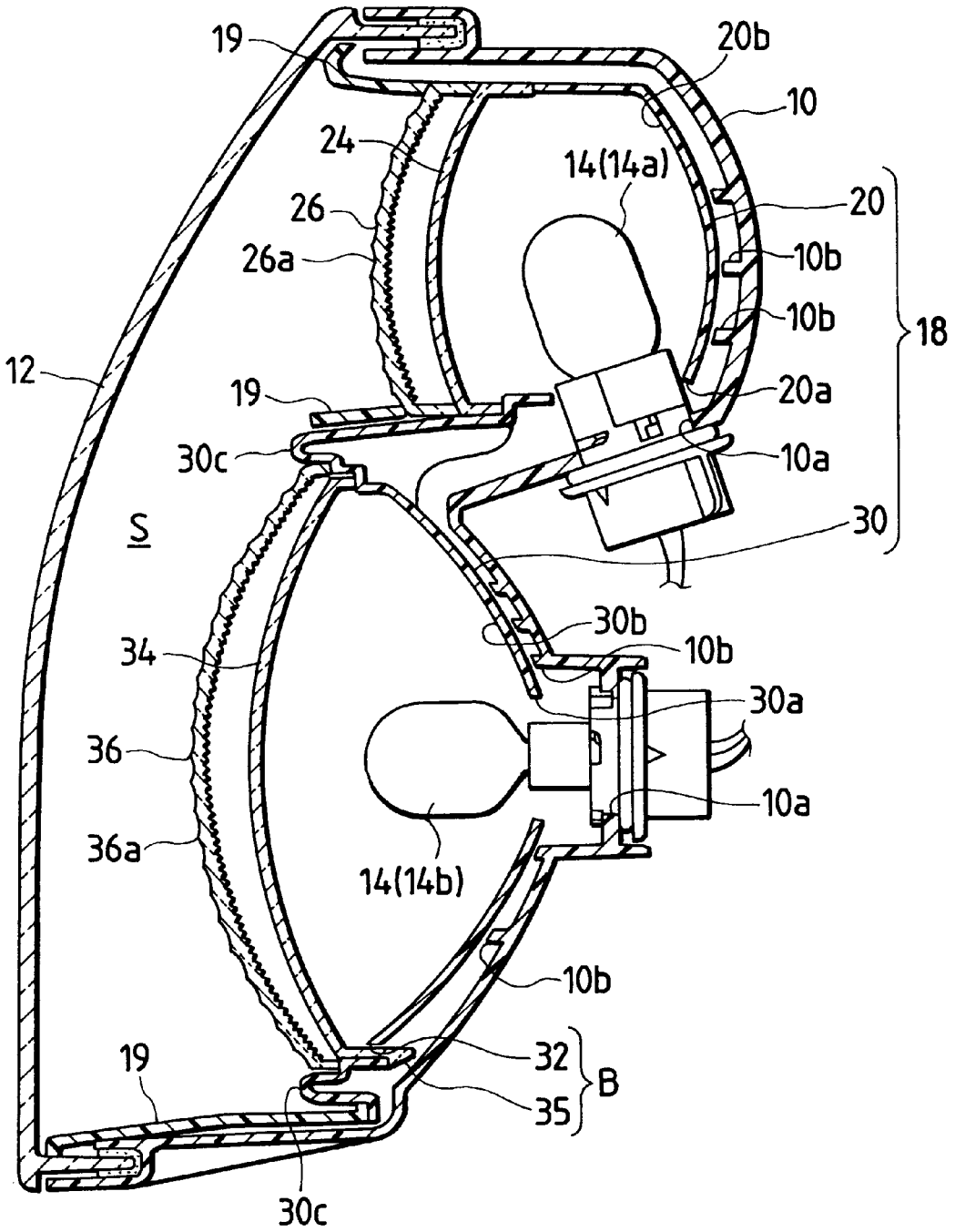
FIG. 2 is a vertical cross sectional view (cross sectional view taken along line II—II shown in FIG. 1) showing the lamp.
Figure 3:
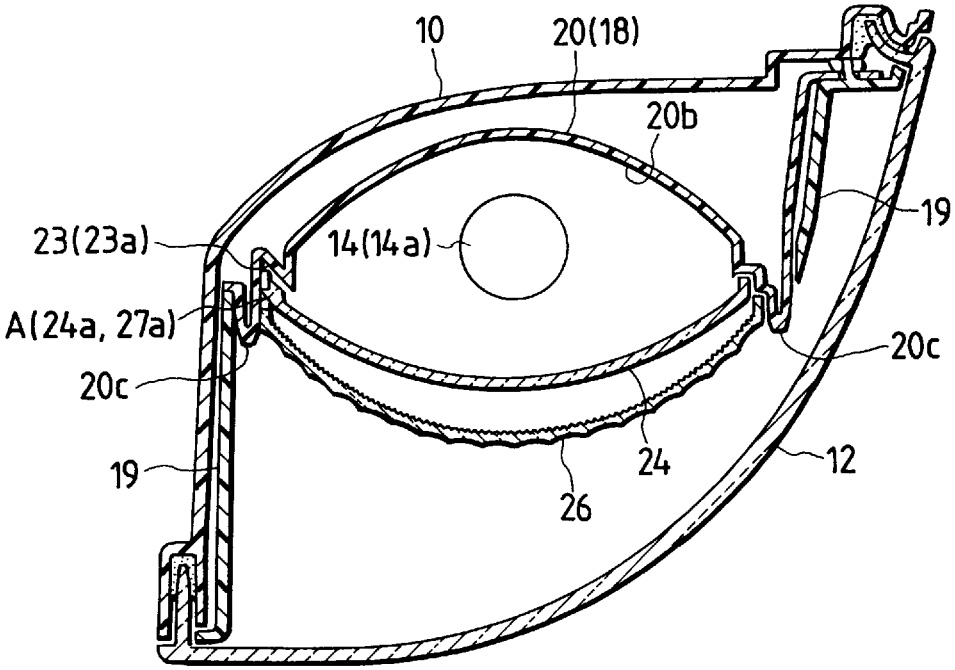
FIG. 3 is a horizontal cross sectional view (cross sectional view taken along line III—III shown in FIG. 1) showing the lamp.
Figure 4:
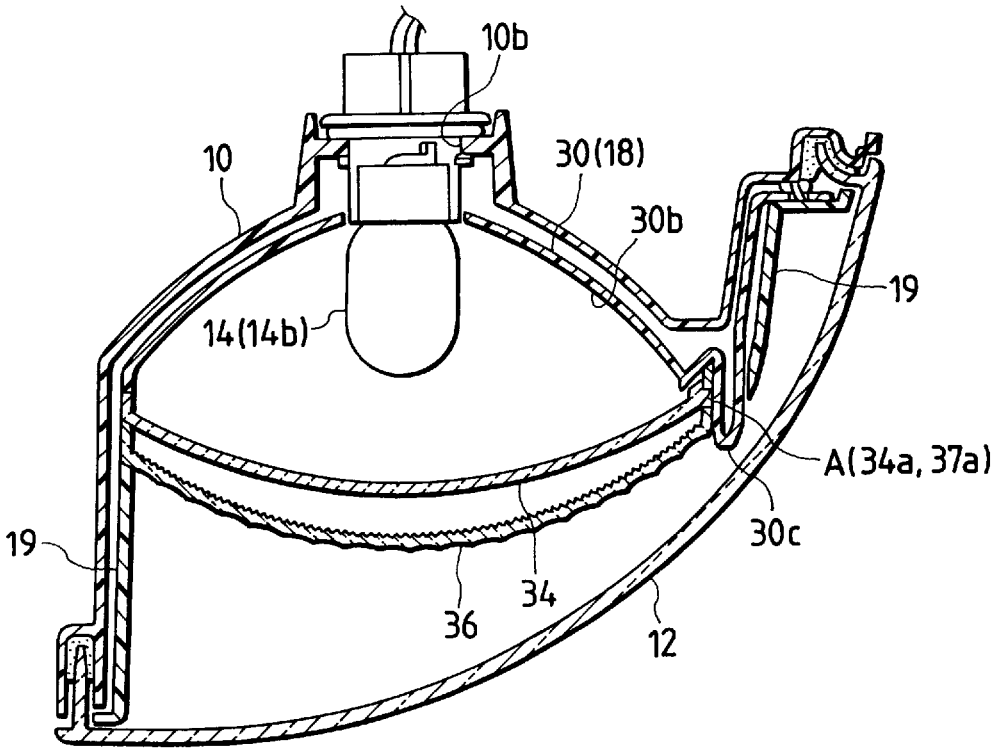
FIG. 4 is a horizontal cross sectional view (cross sectional view taken along line IV—IV shown in FIG. 1) showing the lamp.
Figure 5:
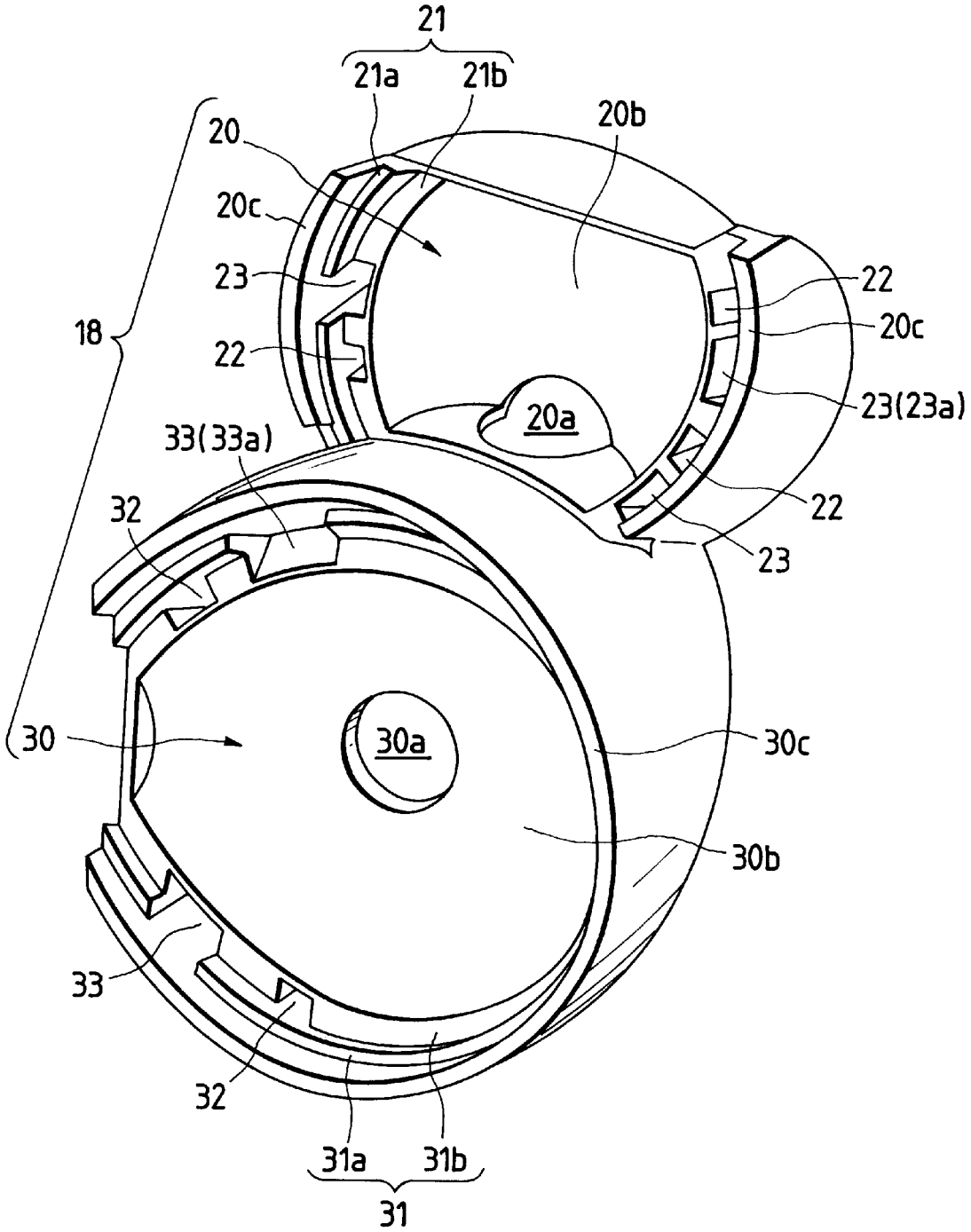
FIG. 5 is a perspective view showing a reflector which is an essential portion of the present invention.
Figure 6:
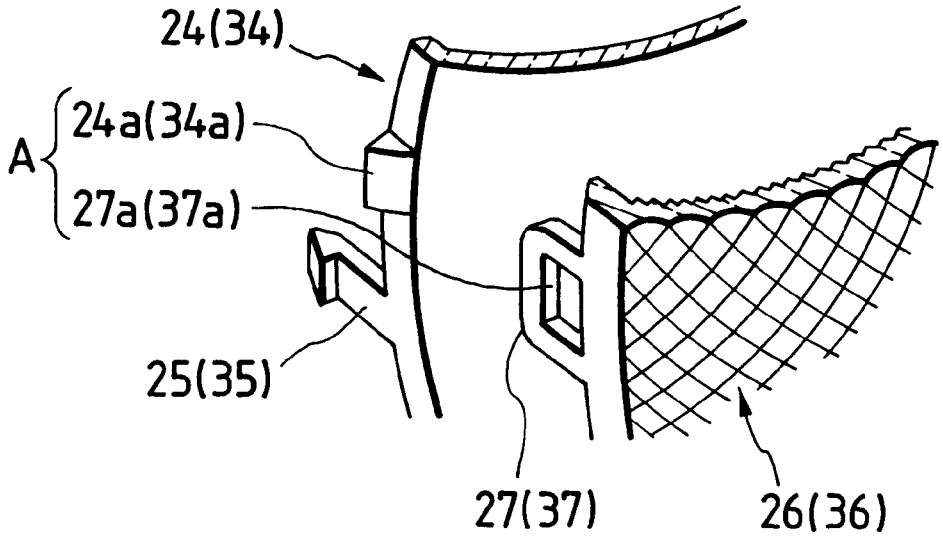
FIG. 6 is an enlarged, exploded and perspective view showing a projection-and-pit lance engagement portion which is an essential portion and which is formed between lenses.
Figure 7:
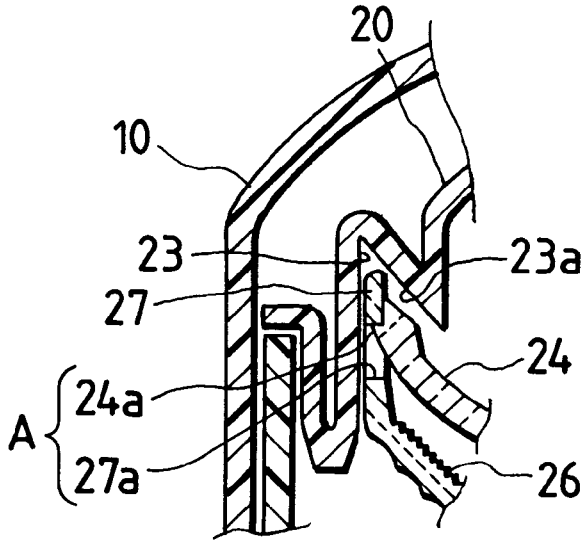
FIG. 7 is an enlarged, horizontal and cross sectional view showing the projection-and-pit lance engagement portion which is an essential portion and which is formed between the lenses.
Figure 8:
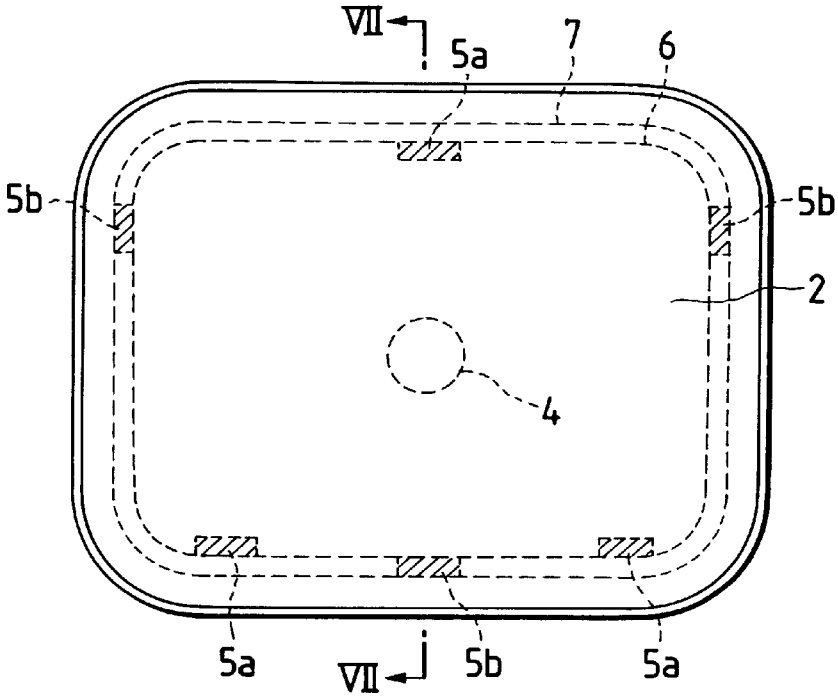
FIG. 8 is a front view showing a conventional rear combination lamp for an automobile.
Figure 9:
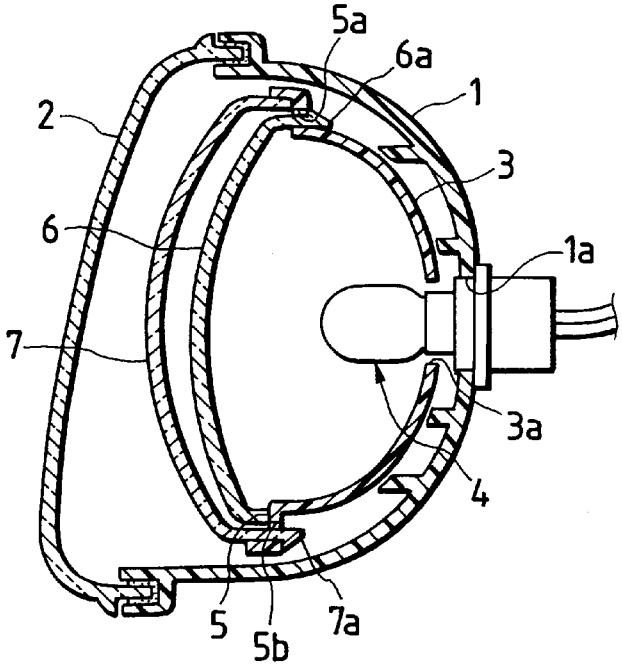
FIG. 9 is a vertical cross sectional view (cross sectional view taken along line IX—IX shown in FIG. 8) showing the lamp.

FIGS. 1 to 7 show a headlamp for an automobile according to the embodiment of the present invention. FIG. 1 is a front view showing a rear combination lamp for an automobile according to the embodiment of the present invention. FIG. 2 is a vertical cross sectional view (a cross sectional view taken along line II—II shown in FIG. 1) of the lamp. FIG. 3 is a horizontal cross sectional view (a cross sectional view taken along line III—III shown in FIG. 1) of the lamp. FIG. 4 is a horizontal cross sectional view (a cross sectional view taken along line IV—IV shown in FIG. 1) of the lamp. FIG. 5 is a perspective view showing a reflector which is an essential portion. FIG. 6 is an enlarged, exploded and perspective view showing a projection-and-pit lance engagement portion which is an essential portion and which is formed between lenses. FIG. 7 is an enlarged and horizontal cross sectional view showing the projection-and-pit lance engagement portion which is an essential portion and which is formed between the lenses.

Referring to the drawings, reference numeral 10 represents a lamp body formed into a container-like shape which has an opened front surface and which is made of synthetic resin. A clear front cover 12 is joined to a rectangular front opening formed into a substantially rectangular shape and provided for the lamp body 10 so that a lamp chamber S is defined. In the lamp chamber S, there are disposed a reflector unit 18 constituted by vertically integrating a reflector 20 arranged to serve as a turn signal lamp and having a substantially rectangular front shape and a reflector 30 arranged to serve as a tail and stop lamp and having a substantially circular front shape. A front opening of each reflectors 20 and 30 has an inner lenses 24 and 34 in a function color and a clear outer lenses 26 and 36 for covering the inner lenses 24 and 34 joined thereto, respectively.

The inner lens 24 has an umber color which is the function color of the turn signal lamp, while the inner lens 34 has a red color which is the function color of the tail and stop lamp. Fish-eye steps 26*a* and 36*a* are formed on the front surfaces of the outer lenses 26 and 36 which are diffusing steps. Therefore, when the lamp is not turned on, the function colors (umber and red) of the inner lenses are viewed as if the colors are passed through a white filter. As a result, an integrated state is realized in the overall lamp chamber S.

In the reflectors 20 and 30, each of bulbs 14*a* and 14*b*, which are light sources inserted into bulb insertion holes 10*a* formed in the lamp body 10, forwards projects over a bulb insertion openings 20*a* and 30*a* provided for the reflectors 20 and 30, respectively. The bulbs 14*a* and 14*b* are disposed such that its filament substantially coincides with the focal point of a paraboloidal effective reflecting surfaces 20*b* and 30*b* of the reflectors 20 and 30, respectively.

The inner lenses 24 and 34 and the outer lenses 26 and 36 are formed to have the sizes to fit to the front openings of the reflectors 20 and 30. As shown in FIGS. 1 and 6, the periphery of each of the inner lenses 24 and 34 is provided with three hook-shape legs 25 and 35, respectively, which are engageable with engagement holes 22 and 32 of the reflectors 20 and 30, respectively, by projection-and-pit lance engagement and which are projections formed at the same intervals in the circumferential direction of the periphery. Projections 24*a* and 34*a* which are engageable with respective engagement holes 27*a* and 37*a* of the outer lenses 26 and 36, respectively, by projection-and-pit lance engagement is formed adjacent to the legs 25 and 35. Reference numerals 27 and 37 represent a leg rearwards projecting over the periphery of the outer lens 26 and 36, respectively. Each of the legs 27 and 37 has the engagement holes 27*a* and 37*a* with which the projections 24*a* and 34*a* of the inner lenses 24 and 34 engage, respectively. When the projections 24*a* and 34*a* engage with the respective engagement holes 27*a* and 37*a*, the inner lenses 24 and 34 and the outer lenses 26 and 36 are integrally secured to each other. That is, the projections 24*a* and 34*a* of the inner lenses 24 and 34 and the engagement holes 27*a* and 37*a* of the outer lenses 26 and 36 constitute a projection-and-pit lance engagement portion, respectively, for engaging and securing the two lenses 20 and 30 to each other.

On the other hand, as shown in FIG. 5, each of the front opening of the reflectors 20 and 30 has a lens engagement portion 21 and 31, respectively, extending along the end of the opening and permits engagement of the outer end of the lens. The lens engagement portions 21 and 31 has the engagement holes 22 and 32, with which the legs 25 and 35 of the inner lenses 24 and 34 engage by the projection-and-pit lance engagement, and a groove 23 and 33 which are capable of accommodating the projection-and-pit lance engagement portion formed between the inner lenses 24 and 34 and the outer lenses 26 and 36, respectively.

The lens engagement portions 21 and 31 are composed of an outer-lens engagement portions 21*a* and 31*a*, which are an outer portion with which the outer end of the outer lenses 26 and 36 engage, and inner-lens engagement portions 21*b* and 31*b*, which are lower and inner portion to which the outer end of the inner lenses 24 and 34 engage, respectively. The engagement holes 22 and 32 are formed between the two lens engagement portions 21*a*, 21*b*, and 31*a*, 31*b*, respectively. The grooves 23 and 33 for accommodating a projection-and-pit lance engagement portion B formed between the two lenses are provided for only the inner-lens engagement portions 21*b* and 31*b*, respectively, which are the inner portion.

When the hook-shape legs 25 and 35 of the inner lenses 24 and 34 engage with the engagement holes 22 and 32 of the lens engagement portions 21 and 31, respectively, both of the inner lenses 24, 34 and the outer lenses 26, 36 integrated with the inner lenses 24, 34 by the projection-and-pit lance engagement are positioned and secured with respect to the reflector 20 and 30, respectively. That is, the legs 25 and 35 of the inner lenses 24 and 34 and the engagement holes 22 and 32 of the reflectors 20 and 30, respectively, constitute the projection-and-pit lance engagement portion B for engaging and securing the inner lenses 24 and 34 and the reflectors 20 and 30 to each other.

Simultaneously with projection-and-pit lance engagement of the legs 25 and 35 of the inner lenses 24 and 34 to the engagement holes 22 and 32 of the reflectors 20 and 30, respectively, the legs 27 and 37 of the inner lenses 24 and 34 which are the projection-and-pit lance engagement portion A between the lenses are accommodated in the grooves 23 and 33, respectively. Thus, the inner lenses 24 and 34 and the outer lenses 24 and 34 are accurately positioned with respect to the reflectors 20 and 30 by both of the projection-and-pit lance engagement portion B and the grooves 23 and 33, respectively.

As a matter of course, the effective reflecting surfaces 20*b* and 30*b* of each of the reflectors 20 and 30 are provided with a mirror surface formed by evaporating aluminum. In addition, the mirror surface is provided for the front surface including the lens engagement portions 21 and 31 provided for the front opening and the outer surface of the reflectors 20 and 30. The bottom portion of the grooves 23 and 33 has an inclined reflecting surfaces 23*a* and 33*a* for introducing external light into the projection-and-pit lance engagement portion A formed between the lenses so that the projection-and-pit lance engagement portion A formed between the lenses is made to be inconspicuous.

That is, when the inside portion of the lamp chamber S is viewed through the front cover 12, there is apprehension that the projection-and-pit lance engagement portion A formed between the lenses is darker than the other region (the region in which the projection-and-pit lance engagement portion between the lenses is not formed). However, light reflected by the inclined reflecting surfaces 23*a* and 33*a* positively illuminates the projection-and-pit lance engagement portion A formed between the lenses. Therefore, the difference in the contrast between the projection-and-pit lance engagement portion A formed between the lenses and the other region (the region in which the projection-and-pit lance engagement portion between the lenses is not formed) is reduced. As a result, the projection-and-pit lance engagement portion A formed between the lenses can be made substantially inconspicuous.

Reference numeral 10*b* shown in FIG. 2 represents a horizontal rib provided for the inside portion of a rear wall of the lamp body 10 and structured to position the reflector. Reference numeral 19 represents an extension structured to cover a gap between the lamp body 10 and the reflector unit 18 and disposed between the reflector unit 18 and the front cover 12. The extension 19 has an opening which coincides with the front opening of the reflectors 20 and 30. The reflector unit 18 in the lamp chamber S is supported and held longitudinally by the extension 19 supported by the front cover 12 and the horizontal rib 10*b* of the lamp body 10.

The extension 19 has a color relating to the color of the car body so that integration with the car body is realized. An outer ends 20*c* and 30*c* of the front opening of the respective reflectors 20 and 30 in the mirror color and surrounding the lenses 24, 26 and 34, 36 projects forwards so that a novel image is realized.

Although the embodiment has the structure that the inner lenses 24 and 34 engage with the respective reflectors 20 and 30 by the projection-and-pit lance engagement, another structure may be employed in which the outer lenses 26 and 36 engage with the reflectors 20 and 30, respectively, by the projection-and-pit lance engagement.

In the foregoing embodiment, the inclined reflecting surfaces 23*a* and 33*a* subjected to the aluminum evaporation process is provided for the bottom of the groove 23 and 33 for accommodating the projection-and-pit lance engagement portion A formed between the lenses. If an inclined surface which is capable of introducing external light into the projection-and-pit lance engagement portion A formed between the lenses is formed, the positive reflecting process, such as the aluminum evaporation or coating for the inclined reflecting surfaces 23*a* and 33*a*, may be omitted.

The structure that the inner lenses 24 and 34 engage with the reflectors 20 and 30 by the projection-and-pit lance engagement may be replaced by a structure in which the outer lenses 26 and 36 engage with the reflectors 20 and 30, respectively, by the projection-and-pit lance engagement.

As can be understood from the description, the vehicle lamp according to the present invention is able to reduce the number of the projection-and-pit lance engagement holes which are visible in the lamp chamber from the outside the lamp. Therefore, the external appearance (the quality of the shape) can be improved.

Since the inner lens and the outer lens previously joined to each other by the projection-and-pit lance engagement is secured to the reflector by the projection-and-pit lance engagement, an operation for joining the lenses can easily be performed.

Further, according to the present invention, the projection-and-pit lance engagement portion which is formed between the lenses and which is dark because of the existence of the outer lens is illuminated with light reflected by the inclined surface provided for the elongating lens-engaging portion of the reflector. Therefore, the difference in the contrast from the region in which the projection-and-pit lance engagement portion between the lenses is not formed can be reduced. As a result, the projection-and-pit lance engagement portion formed between the lenses can be made inconspicuous. As a result, the appearance (the quality of the shape) can be improved.

Moreover, the projection-and-pit lance engagement portion formed between the lenses is illuminated with light reflected by the inclined reflecting surface. Therefore, the difference in the contrast from the region in which the projection-and-pit lance engagement portion between the lenses is not formed can be reduced. Therefore, the appearance (the quality of the shape) can be improved.

Still further, according to the present invention, the lenses are positioned by both of the projection-and-pit lance engagement portion and the groove for accommodating the projection-and-pit lance engagement portion formed between the lenses. Therefore, the lens can accurately be positioned with respect to the reflector.

In addition, the elongated projection-and-pit lance engagement hole (the leg engagement hole) in the lens engagement portion is covered by the outer lens which covers the inner lens so as to be substantially inconspicuous. Therefore, the appearance (the quality of the shape) can be improved.

Furthermore, the function color of the inner lens is viewed as if it has passed through a white filter when the lamp is not turned on. Therefore, a novel integration state can be realized in the overall lamp chamber.

What is claimed is:

1. A vehicle lamp comprising:

a lamp body having a front opening;

an outer cover coupled with the front opening of said lamp body;

a lamp chamber defined by said lamp body and said outer cover;

a light source coupled to said lamp body;

a reflector having a front opening accommodated within said lamp chamber for reflecting forwards light emitting from a light source, said reflector comprising an elongating lens-engaging portion formed along said front opening;

an inner lens and an outer lens disposed at said front opening of said reflector such that said two lenses are, by projection-and-pit lance engagement, secured to said elongating lens-engaging portion of said reflector, said inner lens and said outer lens being integrally secured to each other by the projection-and-pit lance engagement, and at least one of said two lenses is secured to said elongating lens-engaging portion by the projection-and-pit lance engagement.

2. A vehicle lamp according to claim 1, further comprising an inclined surface for introducing external light into a projection-and-pit lance engagement portion formed between said lenses for at least a position of said elongating lens-engaging portion of said reflector which corresponds to said projection-and-pit lance engagement portion formed between said lenses.

3. A vehicle lamp according to claim 2, wherein said inclined surface provided for said elongating lens-engaging portion is subjected to a reflecting process.

4. A vehicle lamp according to claim 2, wherein said elongating lens-engaging portion of said reflector has a groove for accommodating said projection-and-pit lance engagement portion formed between said lenses, and said inclined surface is formed in a bottom portion of said groove.

5. A vehicle lamp according to claim 1, wherein said projection-and-pit lance engagement portion formed between said lens and said reflector is composed of a hook-shape leg rearwards extending over the outer periphery of said inner lens and a leg engaging hole provided for said elongated lens engaging-portion of said reflectors, said projection-and-pit lance engagement portion formed between said two lenses is composed of a projection formed over the outer periphery of said inner lens and a projecting engagement hole formed in the leg extending rearwards over the outer periphery of said outer lens.

6. A vehicle lamp according to claim 1, wherein a plurality of said reflectors are provided in said lamp chamber, and each of said reflectors is provided with an inner lens colored in a function color and a clear outer lens structured to cover said inner lens and having diffusing steps.

* * * * *